United States Patent [19]

Hurley et al.

[11] 4,452,377

[45] Jun. 5, 1984

[54] CONTAINER RELIEF DEVICE AND METHOD

[76] Inventors: Byron H. Hurley, Rte. 1, Box 214-B, Julian, N.C. 27283; Walter G. Ricks, Rte. 1, Box 108-C, Pleasant Garden, N.C. 27313

[21] Appl. No.: 364,492

[22] Filed: Apr. 1, 1982

[51] Int. Cl.[3] ..... B67D 5/08

[52] U.S. Cl. ..... 222/1; 222/3; 222/148; 222/397; 141/7; 141/18; 141/65; 134/152

[58] Field of Search ..... 141/65, 2, 7, 18; 222/3, 397, 504, 174, 402.1, 402.14, 402.15, 148, 149, 151; 73/42.9, 37; 134/96, 98, 152, 153, 155

[56] References Cited

U.S. PATENT DOCUMENTS

| | | | |
|---|---|---|---|
| 2,896,643 | 7/1959 | Ottoson | 134/98 X |
| 2,900,779 | 8/1959 | Baxter et al. | 53/381 |
| 2,969,073 | 1/1961 | Du Broff | 222/148 X |
| 3,091,958 | 6/1963 | Robins | 73/49.2 |
| 3,473,499 | 10/1969 | Bishop | 113/1 |
| 3,521,792 | 7/1970 | Davidson | 222/148 X |
| 3,587,597 | 6/1971 | Courtney et al. | 134/96 X |
| 3,618,429 | 11/1971 | Froeliger | 81/3.2 |
| 3,651,751 | 3/1972 | Randrup | 99/275 |
| 4,106,672 | 8/1978 | Tecco et al. | 222/151 |
| 4,172,397 | 10/1979 | Herbert | 81/3.2 |
| 4,248,360 | 2/1981 | Crump | 222/174 |

*Primary Examiner*—Joseph J. Rolla

[57] ABSTRACT

The invention herein consists of an apparatus and method whereby containers such as syrup cannisters can be depressurized for disassembly and cleaning after use. The invention includes a relief head having a circular array of depending resilient, projecting members which are positioned to contact the dispensing valves of the containers and to allow air or other gases contained therein to escape.

16 Claims, 7 Drawing Figures

CONTAINER RELIEF DEVICE AND METHOD

BACKGROUND AND OBJECTIVES OF THE INVENTION

Soft drink distributors and others often deliver syrups for soda fountain dispensing to their customers in containers which may have a capacity of ten gallons or less. The containers are used by affixing pressure lines whereby the syrup is dispensed in small quantities and mixed with carbonated water for individual servings. After the syrup has been completely removed from the containers, the pressure lines are disconnected and the empty containers are replaced with full ones. Thereafter, the emptied containers are returned to the packager for cleaning and refilling. However, before the containers can be cleaned, they must be relieved of any internal pressure caused by the gases remaining therein from the dispensing cycle.

The containers can be manually relieved of the internal pressure before disassembly for cleaning purposes but as the demand for such containers grows manual operations become impractical, inefficient and too costly.

With this background in mind, the present invention was developed and one of its objectives is to provide a device for relieving the internal pressure of syrup containers having dispensing valves in a fast, efficient manner.

It is another objective of the present invention to provide a method for relieving the internal pressure of containers in a positive, inexpensive fashion.

It is yet another objective of the present invention to provide a device having a pressure relief head having a series of resilient, projecting members which will locate and depress dispensing valve stems simultaneously.

Another objective of the present invention is to provide a method for relieving or depressurizing containers in rapid style.

DESCRIPTION OF THE PREFERRED EMBODIMENT

The preferred apparatus of the invention includes a means for delivering the container to a desired location, a relief head which includes a circular array of depending projecting members and apparatus for moving the relief head into and out of contact with the container. The projecting member of the preferred embodiment has a U-shaped portion which contributes resiliency to said projecting member.

In the preferred method of the invention the container is positioned for depressurizing, whereupon the relief head is urged into contact with the dispensing valve stem of the container whereby one or more of said projecting members depress dispensing valve stems positioned on said container allowing air or other gases to escape therefrom.

SUMMARY OF THE INVENTION

The present invention includes apparatus for relieving the internal pressure of a container which has one or more dispensing valves. In operation, the container is delivered to a particular location whereupon the device lowers a relief head having a series of resilient projections which contact the container and the projections "find" the dispensing valves and open them to allow internal gases to escape. A plurality of resilient projecting members are situated on the relief head to insure relief, regardless of the degree of rotation of the container relative to the relief head. As one or more projecting members depress the dispensing valve stems certain remaining projecting members are compressed against the dispensing valve and, upon being withdrawn from the container the compressed projecting members relax and extend back to their normal configuration.

Figure 1:
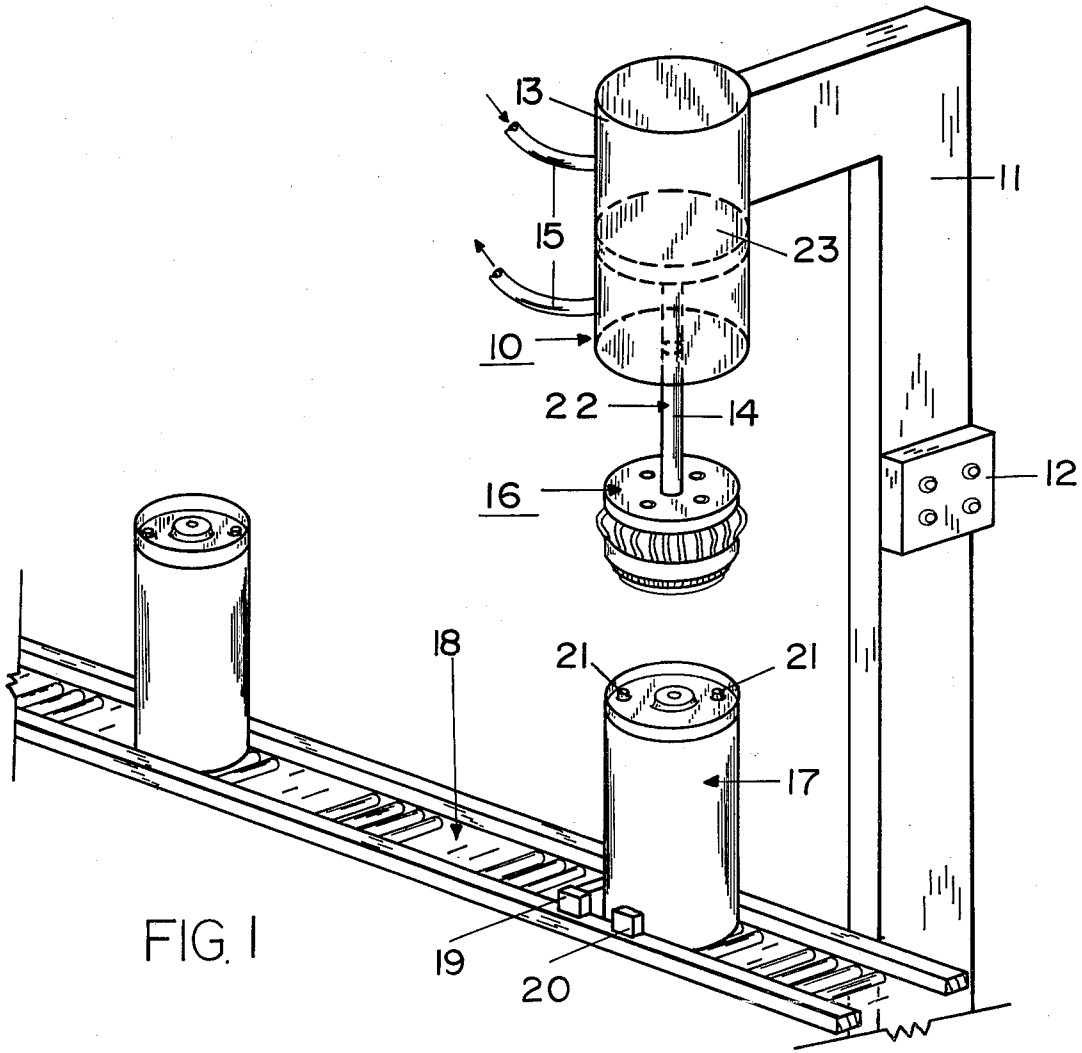
FIG. 1 is a schematic view of the invention in operation.
Figure 4:
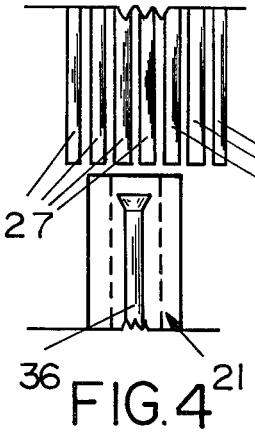
FIG. 4 is a schematic view of a plurality of projecting members prior to contacting the valve stem.

For a more detailed description of the drawings, as shown in FIG. 1, apparatus 10 demonstrates machinery by which the internal pressure of a container can be relieved and includes support means 11 and control panel 12 which may be automatically or manually operated as required. Apparatus 10 includes hydraulic cylinder 13 which controls piston rod 14 by fluid conduits 15. Relief head 16 is shown in a raised posture prior to engagement with container 17. Conveying means 18 is shown in FIG. 1 with container 17 positioned thereon for engagement by relief head 16 with container stop means 19 which may be, for example, an air cylinder or other apparatus to controllably block the path of container 17 as it moves along conveying means 18. Switch means 20 is shown positioned on conveying means 18 and may be, for example, a proximity switch to sense the presence of container 17 and to activate stop means 19.

As would be understood, compressed air from a source of supply (not shown) would enter one of the fluid conduits 15 causing the piston head 23 in hydraulic cylinder 13 to move downwardly thereby forcing relief head 16 to engage container 17 positioned below whereby the internal pressure of container 17 is relieved through dispensing valves 21. As is understood, relief head 16 is urged into contact with container 17 by moving means 22 which includes piston rod 14 and piston head 23 shown partially within hydraulic cylinder 13 in FIG. 1.

Figure 2:
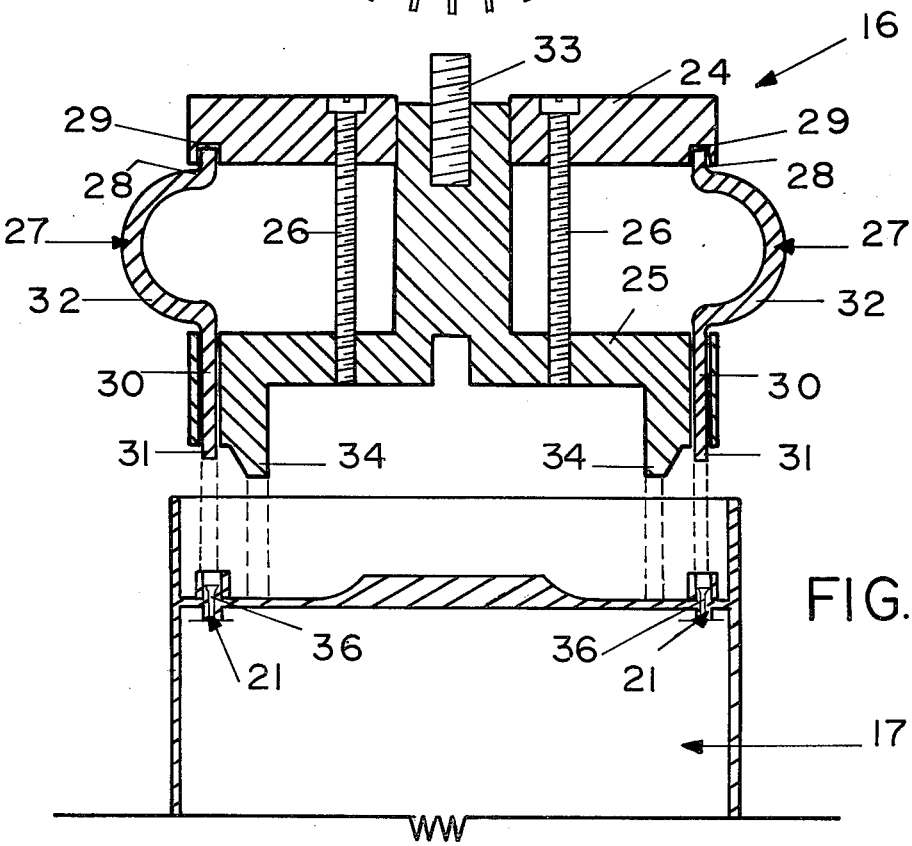
FIG. 2 is a cross-sectional view of the relief head and container to be degassed.

Relief head 16 as shown in more detail in FIG. 2 includes upper cap member 24 and lower body member 25. Upper cap member 24 is held to lower body member 25 by securing means 26. Projecting members 27 are shown with upper leg member 28 positioned in upper cap groove 29. Lower leg member 30 of projecting member 27 is shown extending through lower body member 25 with tip 31 protruding therefrom. U-shaped portion 32 of projecting member 27 thus has upper leg member 28 and lower leg member 30 on opposite sides with lower member 30 having a greater length as shown in FIG. 2.

Piston rod mounting means 33 is also shown in FIG. 2 threaded into lower body member 25 and extending above upper cap member 24. Container 17 is shown in partial view in FIG. 2 and includes dispensing valves 21.

Figure 5:
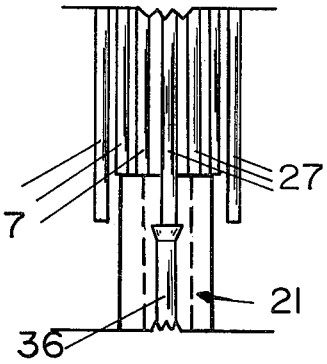
FIG. 5 demonstrates the projecting members as shown in FIG. 4 with contact being made to open the dispensing valve stems.
Figures 6, 7:
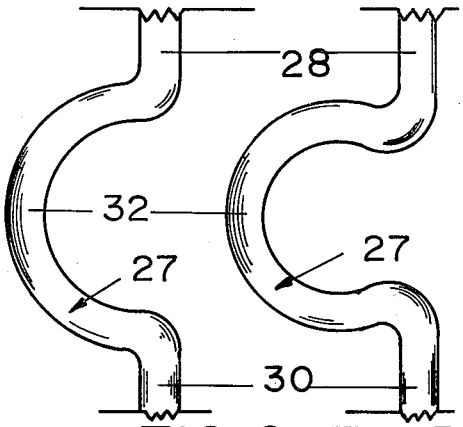
FIG. 6 shows the U-shaped section of one of the projecting members in relaxed form.
FIG. 7 is a view of the U-shaped section of the projecting member as shown in FIG. 6 in compressed fashion.
Figure 3:
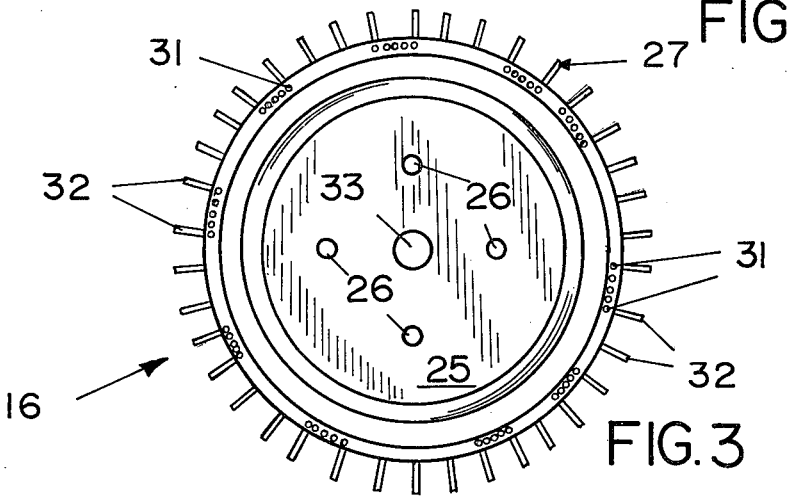
FIG. 3 is a schematic bottom plan view of the relief head as shown in FIG. 2.

As would be understood, a container may have one or more dispensing valves 21 which, when engaged with projecting members 27, will be depressed and thereby allow any internal gas or other substance under pressure to escape. Ring member 34 is also shown in FIG. 2 which acts as a guide in cooperation with dispensing valve 21 to insure proper direction of projecting member 27 relative to dispensing valve 21. As shown in FIG. 3, projecting members 27 encircle the periphery of relief head 16 with tips 31 extending through lower body member 25. Thus, when container 17 is contacted by relief head 16 at least one or more projecting members 27 contact dispensing valve 21 and open it by depressing valve stem 36 as seen in FIG. 5. As further shown in FIG. 5, adjacent projecting members 27 do not enter dispensing valve 21 but may contact the upper portion of dispensing valve 21 and compress. The compressing action is depicted in FIG. 7 whereby U-shaped portion is compressed with upper leg members 28 and lower leg members 30 being urged somewhat closer together as shown contrasted to the relaxed U-shaped portion of projecting member 27 as shown in FIG. 6. Thus, U-shaped portion 32 of projecting member 27 provides the resiliency for projecting member 27 which may be a heavy wire material which, because of its U-shaped configuration, provides a spring-like quality.

As would be understood, one or more dispensing valves 21 may be encountered and, because of the entire periphery of relief head 16 having projecting members 27, regardless of the rotation of containers 17, there will always be a projecting member 27 available to enter dispensing valve 21 with adjacent projecting members being compressed upon the top of dispensing valve 21 as shown in FIG. 5.

As shown and would be understood from FIG. 3, one of every four U-shaped portions 32 is turned outwardly while three are turned inwardly although all projecting members 27 are not shown in FIG. 3.

Various modifications or changes can be made to the present invention and the examples and illustrations herein are not intended for limiting purposes.

We claim:

1. A device for relieving the internal pressure of a pressurized container having a dispensing valve, said dispensing valve being positioned on an end wall of the container adjacent the periphery thereof, comprising: a moveably mounted relief head, a circular array of resilient projecting members, said projecting members depending from said relief head, and guide means wherein said guide means is joined to said relief head for directing at least one of said projecting members to the dispensing valve irrespective of the angular position of said dispensing valve with respect to said circular array of projecting members.

2. A device as claimed in claim 1 wherein said guide means comprises a ring member.

3. A device as claimed in claim 1 wherein each of said projecting members includes upper and lower leg members, a U-shaped portion, opposite sides of said U-shaped portion joining said upper and lower leg members.

4. A device as claimed in claim 1 wherein each of said projecting members comprises a spring member.

5. A device as claimed in claim 4 wherein each of said spring members comprises a wire member.

6. A device as claimed in claim 1 wherein said relief head comprises an upper cap member and a lower body member.

7. A device as claimed in claim 6 wherein each of said projecting members extends through said lower body member.

8. Apparatus for relieving the internal pressure of a pressurized container having a dispensing valve, said dispensing valve being positioned on an end wall of the container adjacent the periphery thereof, comprising: a container positioning means, a moveably mounted pressure relief means, said pressure relief means including a relief head, said relief head including a circular array of resilient depending projecting members, guide means, said guide means being joined to said relief head for directing at least one of said projecting members to the dispensing valve irrespective of the angular position of said dispensing valve with respect to said circular array of projecting members, and moving means, wherein said moving means is connected to said relief head for urging said relief head into contact with container.

9. Apparatus for relieving internal pressure of a container as claimed in claim 8 wherein said container positioning means includes conveying means.

10. Apparatus for relieving internal pressure of a container as claimed in claim 8 wherein said moving means includes cylinder means.

11. Apparatus for relieving internal pressure of a container as claimed in claim 8 wherein said moving means lowers said relief head into contact with the container.

12. A method for relieving the internal pressure of a pressurized container having at least one dispensing valve, said dispensing valve being positioned on an end wall of the container adjacent the periphery thereof, comprising the steps of: positioning the container for relief, contacting said container with a relief head having a circular array of resilient projecting members depending therefrom, and depressing the dispensing valve with at least one of said projecting members to thereby relieve the pressure in the container irrespective of the angular position of said dispensing valve respect to said circular array of projecting members.

13. A method of relieving internal pressure from a container as claimed in claim 12 and including the step of compressing at least one of said projecting members.

14. A method of relieving internal pressure of a container as claimed in claim 12 whereby the step of contacting the container with a relief head includes the step of guiding one of said projecting members to the dispensing valve.

15. A method of relieving internal pressure of a container as claimed in claim 12 and including the step of withdrawing said relief head from the container after depressing the dispensing valve.

16. A method of relieving internal pressure of a container as claimed in claim 12 whereby contacting the container with a relief head includes the step of depressing a plurality of dispensing valves.

* * * * *